US009399824B2

(12) United States Patent
Hartmann et al.

(10) Patent No.: US 9,399,824 B2
(45) Date of Patent: Jul. 26, 2016

(54) PYROPHOSPHATE-CONTAINING BATH FOR CYANIDE-FREE DEPOSITION OF COPPER-TIN ALLOYS

(71) Applicant: Atotech Deutschland GmbH, Berlin (DE)

(72) Inventors: Philip Hartmann, Berlin (DE); Klaus-Dieter Schulz, Berlin (DE); Lars Kohlmann, Berlin (DE); Heiko Brunner, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 203 days.

(21) Appl. No.: 14/100,633

(22) Filed: Dec. 9, 2013

(65) Prior Publication Data

US 2014/0124376 A1 May 8, 2014

Related U.S. Application Data

(62) Division of application No. 12/866,996, filed as application No. PCT/EP2009/003886 on May 29, 2009, now abandoned.

(30) Foreign Application Priority Data

Jun. 2, 2008 (EP) ..... 08010058

(51) Int. Cl.
*C25D 3/58* (2006.01)
*C25D 3/60* (2006.01)

(52) U.S. Cl.
CPC ... *C25D 3/58* (2013.01); *C25D 3/60* (2013.01)

(58) Field of Classification Search
CPC ..... C25D 3/56; C25D 3/58; C25D 3/60
USPC ..... 205/241
See application file for complete search history.

(56) References Cited

U.S. PATENT DOCUMENTS

| | | | | |
|---|---|---|---|---|
| 2,493,092 | A | 1/1950 | Stareck | |
| 4,469,564 | A * | 9/1984 | Okinaka | C25D 3/38 204/252 |
| 6,210,556 | B1 | 4/2001 | Toben et al. | |
| 6,416,571 | B1 | 7/2002 | Kaneko et al. | |
| 2003/0106802 | A1 | 6/2003 | Hagiwara et al. | |
| 2004/0112756 | A1 | 6/2004 | Boyd et al. | |
| 2005/0166790 | A1 | 8/2005 | Urata et al. | |
| 2006/0016693 | A1 | 1/2006 | Wang et al. | |
| 2007/0007143 | A1 * | 1/2007 | Hayashi | C25D 3/38 205/125 |
| 2007/0084732 | A1 * | 4/2007 | Wang | C25D 3/02 205/296 |

FOREIGN PATENT DOCUMENTS

| | | | | |
|---|---|---|---|---|
| EP | 0284234 | A2 | 9/1988 | |
| JP | 10-102278 | A | 4/1998 | |
| WO | 2004/005528 | A2 | 1/2004 | |
| WO | WO 2004005528 | A2 * | 1/2004 | C25D 3/58 |

OTHER PUBLICATIONS

Kuznetsov et al., "Electrodeposition of Copper-Containing Polymer Coatings from Sulfate Electrolytes Containing N-Methylpyrrolidone", Protection of Metals (no month, 2005), vol. 41, No. 5, pp. 427-430.*

M. Jordan et al., "The Electrodeposition of Tin and its Alloys", Eugen G. Leuze Publishers, 1st Edition, 1995), Chapter 13, pp. 155-163.

Kuznetsov et al., "Electrodeposition of Copper-Containing Polymer Coatings from Sulfate electrolytes Containing N-Methylpyrrolidone", Protection of Metals (2005), 41(5), pp. 427-430.

* cited by examiner

*Primary Examiner* — Edna Wong

(74) *Attorney, Agent, or Firm* — Mintz Levin Cohn Ferris Glovsky and Popeo, P.C.; Peter F. Corless; Christopher R. Cowles

(57) ABSTRACT

A pyrophosphate-containing bath for the cyanide-free deposition of copper alloys on substrate surfaces, comprising a reaction product of a secondary monoamine with a diglycidyl ether, is described. The electrolyte bath is suitable for the galvanic deposition of glossy white, even and uniform copper-tin alloy coatings.

14 Claims, No Drawings

PYROPHOSPHATE-CONTAINING BATH FOR CYANIDE-FREE DEPOSITION OF COPPER-TIN ALLOYS

FIELD OF THE INVENTION

The invention relates to a pyrophosphate-containing bath for the cyanide-free deposition of copper-tin alloys on substrate surfaces, which comprises a reaction product of a secondary monoamine with a diglycidyl ether as additive.

Homogenous, glossy copper-tin alloy layers, the alloy ratio of which may be directly adjusted depending on the used metal salt ratio within the electrolyte, may be cyanide-freely deposited by the bath.

PRIOR ART

Tin alloys and particularly copper-tin alloys as alternative for nickel depositions have become the focus of attention. Galvanically deposited nickel layers are usually used not only for decorative but also for functional applications.

Despite their good properties, nickel layers are problematic as regards health, particularly regarding direct skin contact, due to their sensibilising properties. Therefore, alternatives are of greatest interest.

Besides the tin-lead alloys, which are established in the sector of electronics but ecologically problematic, copper-tin alloys have been taken into consideration as replacement in the last few years. Chapter 13 (pp. 155 to 163) of the document "*The Electrodeposition of Tin and its Alloys*" by Manfred Jordan (Eugen G. Leuze Publ., 1st ed., 1995) gives a review on the known types of baths for copper-tin alloy depositions.

Cyanide-containing copper-tin alloy baths are industrially established. Due to regulations that become more and more stricter and the high toxicity and the problematic and expensive disposal of these cyanide-containing baths, there is an increasing need for cyanide-free copper-tin electrolytes.

For this purpose cyanide-free pyrophosphate-containing electrolytes have been sporadically developed. JP 10-102278 A describes a copper-tin alloy bath on pyrophosphate basis, which contains a reaction product of an amine and a epihalodrine derivative (molar ratio 1:1), an aldehyde derivative and optionally, depending on the application, tensides as additive. U.S. Pat. No. 6,416,571 B1 also describes a pyrophosphate-based bath, which also contains a reaction product of an amine and an epihalohydrine derivative (molar ratio 1:1), a cationic tenside, optionally further surface-active tensides and an antioxidant agent as additives.

The disadvantage of the above-mentioned baths is that particularly as regards drum plating, no uniform alloy layers are obtained, so that the products have no uniform colouring and gloss.

To solve this problem, WO 2004/005528 suggests a pyrophosphate-containing copper-tin alloy bath that contains a reaction product of an amine derivative, particularly preferred piperazine, of an epihalohydrine derivative, particularly epichlorhydrine, and of a glycidyl ether as additive. To produce this reaction mixture, a mixture consisting of epichlorhydrine and the glycidyl ether is slowly added to an aqueous solution of the piperazine under precise temperature control, whereby the temperature of 65 to 80° C. has to be kept. The disadvantage of this additive is the reaction procedure that is difficult to control, particularly at high temperatures, since such reaction products tend to post-reaction at too high reaction temperatures and/or storage temperatures and, thus, to the formation of high-molecular and, thus, partially water-insoluble and ineffective polymers. One way out of this dilemma may only be achieved by a reaction procedure in very high dilution (<1% by weight). Such low concentrated additive solutions result in a disadvantageous solution formation of the electrolyte if several doses are added. This may result in fluctuating depositions if the electrolyte is used for a longer period of time.

Moreover, this electrolyte shows weaknesses as regards applications in the rack plating. For example, the quality of the deposited layers, which often show a haze, very strongly depends on the way of movement of goods during the electrolysis. Furthermore, he thus obtained copper-tin coatings often show porosities, which is particularly problematic regarding decorative coatings.

Example A-11 on page 26 of WO 2004/005528 describes the use of a reaction product of the diamine piperazine with ethylene glycol diglycidyl ether. This reaction product only provides dull white-bronze layers.

SUMMARY OF THE INVENTION

Therefore, it is the objective of the invention to develop a galvanic bath for copper-tin alloys, which enables the production of optically appealing copper-tin alloy layers.

A more homogenous copper-tin alloy metal distribution and an optimal copper/tin metal ratio are to be additionally adjusted. Moreover, a uniform layer thickness with high gloss and the regularity of the distribution of the alloy components in the coating are to be maintained over a large current density range.

The subject-matter of the invention is a pyrophosphate-containing bath for the cyanide-free deposition of copper alloys on substrate surfaces comprising a reaction product of a secondary monoamine with a diglycidyl ether.

The secondary monoamines and the diglycidyl ethers may thereby be used individually or in mixture to produce the reaction product.

DESCRIPTION OF PREFERRED EMBODIMENTS OF THE INVENTION

Preferred secondary amines are dimethylamine, diethylamine, dipropylamine, dibutylamine, dipentylamine, diisoproylamine, piperidine, thiomorpholine, morpholine and mixtures thereof. Particularly preferred is the use of morpholine. Particularly preferred diglycidyl ethers are glycerol diglycidyl ether, poly(ethylene glycol) diglycidyl ether, poly (propylene glycol) diglycidyl ether and their mixtures.

A particularly preferred reaction product for use in the bath according to the invention is the reaction product of morpholine with glycerol diglycidyl ether.

The organic additives may be easily depicted by reacting the respective amine components with the respective diglycidyl ethers in an appropriate solvent such as, e.g., water, aqueous alcoholic solutions, aprotic solvents such as, e.g., ethers, NMP, NEP, DMF, DMAc or also in substance at room temperature or in heat under standard pressure or increased pressure. Regarding the production in substance, it is purposeful to dilute the reaction product with water after the end of the reaction. The reaction times needed therefor are between a few minutes and several hours, depending on the ingredient used. Besides the classic heat sources, a microwave oven may also be used here. In the case of the use of water as solvent or the production in substance, the resultant reaction products may be used directly, so that a production in aqueous medium or in substance is the preferred manufacturing process. The preferred temperatures of the production of the reaction products according to the invention are 15 to 100° C., particularly preferred 20 to 80° C. The molar ratios of diglycidyl ether/amine are 0.8 to 2, particularly preferred 0.9 to 1.5. Compared to the additive of WO 2004/005528, the very simple production is particularly advantageous regarding these additives.

The reaction products according to the invention may be used individually or as mixture of several different reaction products of the aforementioned type in a concentration of 0.0001 to 20 g/l, preferably 0.001 to 1 g/l and particularly preferred 0.01 to 0.6 g/l.

According to a preferred embodiment, the bath according to the invention contains orthophosphoric acid, an organic sulfonic acid, boric acid, an antioxidant agent and an organic brightener that is different from the reaction product.

The electrolyte baths according to the invention may contain copper pyrophosphate in a concentration of 0.5 to 50 g/l as copper ion source, whereby concentrations of 1 to 5 g/l are particularly preferred.

The baths according to the invention may contain tin pyrophosphate in a concentration of 0.5 to 100 g/l as tin-ion source, whereby concentrations of 10 to 40 g/l are particularly preferred.

Besides the aforementioned tin pyrophosphates and copper pyrophosphates, other water-soluble tin salts and copper salts may also be used such as, e.g. tin sulfate, tin methanesulfonate, copper sulfate, copper methanesulfonate, which may be re-complexated by adding appropriate alkali metal pyrophosphates to the respective pyrophosphates within the electrolyte. The concentration ratio of pyrophosphate to tin/copper is thereby to be 3 to 80, particularly preferred 5 to 50.

The alkali metal pyrophosphates that might be contained in the baths according to the invention are particularly preferably the sodium pyrophosphates, potassium pyrophosphates and ammonium pyrophosphates in concentrations of 50 to 500 g/l, particularly preferred of 100 to 400 g/l.

The antioxidant agents that might be contained in the baths according to the invention comprise hydroxylated aromatic compounds such as, e.g., catechol, resorcinol, brenzcatechin, hydroquinone, pyrogallol, α-naphthol, β-naphthol, phloroglucin, and sugar-based systems such as, e.g., ascorbic acid, sorbitol, in concentrations of 0.1 to 1 g/l.

Monosulfonic acids as well as polysulfonic acids such as, e.g., methanesulfonic acid, methanedisulfonic acid, ethanesulfonic acid, propanesulfonic acid, 2-propanesulfonic acid, butanesulfonic acid, 2-butanesulfonic acid, pentanesulfonic acid, hexanesulfonic acid, decanesulfonic acid, dodecanesulfonic acid as well as their salts and their hydroxylated derivatives may be used as alkylsulfonic acids. Particularly preferred is the use of methanesulfonic acid in a concentration of 0.01 to 1 g/l.

The baths according to the invention have a pH value of 3 to 9, particularly preferred 6 to 8.

As opposed to the additives known from WO 2004/005528, the additive according to the invention, i.e., the reaction product of a secondary monoamine with a diglycidyl ether, makes it possible to deposit the alloy on the substrate with a uniform layer thickness with high gloss at regular distribution of the alloy components in the coating over a large current density range. Moreover, the use of the additive according to the invention does not result in the formation of pores. Finally, fogging may be avoided in rack plating.

The aforementioned effects may even be increased by adding N-methylpyrrolidone. The N-methylpyrrolidone is preferably used in a concentration of 0.1 to 50 g/l, particularly preferably 0.5 to 15 g/l.

The baths according to the invention may be produced by common methods, for example, by adding the specific amounts of the above-described components to water. The amount of the base components, acid components and buffer components such as, e.g., sodium pyrophosphate, methanesulfonic acid and/or boric acid, should preferably be selected in such a way that the bath attains the pH range of at least 6 to 8.

The baths according to the invention deposit an even and ductile copper-tin alloy layer without discolouration at each usual temperature of about 15 to 50° C., preferably 20° C. to 40° C., particularly preferably 20° C. to 30° C. At these temperatures the baths according to the invention are stable and effective over a wide, set current density range of 0.01 to 2 A/dm$^2$, particularly preferably 0.25 to 0.75 A/dm$^2$.

The baths according to the invention may be operated in a continuous or intermittent way, and the components of the bath will have to be amended from time to time. The components of the bath may be added individually or in combination. Moreover, they may vary over a wide range, depending on the consumption and the present concentrations of the individual components.

Table 1 shows, according to a preferred embodiment, the deposition results of the tin-copper alloy layers in the electrolytes according to the invention compared to the electrolytes of document WO 2004/005528.

| charge | electrolyte | concentration used brightener [ml/l] | appearance of the deposition |
|---|---|---|---|
| 1 | electrolyte according to the invention with additive A (Preparation and Application Example 1) | 0.2 | very glossy white deposition |
| 2 | electrolyte according to WO 2004/005528 (Comparative Example 11, additive conc.: 10% by weight | 0.5 | grey dull deposition with low adhesion |
| 3 | electrolyte according to WO 2004/005528 (Comparative Example 12, additive conc.: 1% by weight) | 14 | glossy white deposition with isolated pores and fogs |

As evident from Table 1, better results as regards appearance and the effective concentration are obtained if the additives according to the invention are used.

Thus, the additives according to the invention are more active by the factor of up to 1.75 than the additives described in the patent specification WO 2004/005528.

Compared to the electrolytes of WO 2004/005528, one advantage of the tin-copper baths according to the invention is the surprisingly low consumption of the additives according to the invention compared to the reaction products of the piperazine with epichlorhydrine and glycidyl ether.

Generally, the aqueous baths according to the invention may be used for all types of substrates on which copper-tin alloys may be deposited. Examples of purposeful substrates include copper-tin alloys, ABS plastic surfaces coated with chemical copper or chemical nickel, mild steel, high-grade steel, spring steel, chromium steel, chromium-molybdenum steel, copper and tin.

Therefore, a further subject-matter is a method for galvanic deposition of copper-tin alloys on usual substrates, whereby the bath according to the invention is used. The substrate to be coated is thereby introduced into the electrolyte bath.

The deposition of the coatings in the method according to the invention preferably takes place at a set current density of 0.25 to 0.75 A/dm$^2$ as well as at a temperature of 15 to 50° C., preferably 20 to 30° C.

The method according to the invention may be conducted in the application for mass production components, for example, as drum plating method and for the deposition on larger workparts as rack plating method. Anodes that may be soluble are thereby used such as, for example, copper anodes, tin anodes or appropriate copper-tin alloy anodes, which are used as copper ion source and/or tin ion source at the same time, so that the copper and/or tin that is deposited on the cathode is substituted by dissolution of copper and/or tin at the anode.

On the other hand, insoluble anodes (e.g., platinated titanium mixed oxide anodes) might be used, whereby the copper ions and tin ions that were detracted from the electrolyte have to be added again in another way, e.g., by adding the corresponding soluble metal salts. As it is possible in the galvanic deposition, the method according to the invention may be operated under nitrogen injection or argon injection, with movement of goods or without movement, without resulting in any disadvantages for the obtained coatings. To avoid or reduce oxidations of the added additives or the tin(II) ions, it may be worked with the separation of the electrode rooms or with the use of membrane anodes, whereby a substantial stabilisation of the electrolyte may be achieved.

Commercially available continuous current rectifiers or pulse rectifiers are used as current source.

EXAMPLES

Preparation Example 1

4 g (0.0455 mol) morpholine and 9.29 g (0.0455 mol) glycerol diglycidyl ether are dissolved in 19.84 g water in a round bottom flask, and the reaction mixture is heated to 80° C. for one hour. 33.13 g of a colourless liquid are obtained, which is subsequently used for application-technological tests.

Preparation Example 2

1.67 g (0.0190 mol) morpholine and 10 g (0.0190 mol) poly(ethylene glycol) diglycidyl ether (molecular weight 526.6 g/mol) are dissolved in 17.44 g water in a round bottom flask, and the reaction mixture is heated to 80° C. for one hour. 29.11 g of a colourless liquid are obtained, which is subsequently used for application-technological tests.

Preparation Example 3

2.50 g (0.0287 mol) morpholine and 2.92 g (0.0143 mol) glycerol diglycidyl ether and 7.53 g (0.0143 mol) poly(ethylene glycol) diglycidyl ether are dissolved in 19.43 g water in a round bottom flask, and the reaction mixture is heated to 80° C. for one hour. 32.38 g of a colourless liquid are obtained, which is subsequently used for application-technological tests.

Preparation Example 4

1.67 g (0.019 mol) morpholine and 12.16 g (0.019 mol; average molecular weight: 640 g/mol) poly(propylene glycol) diglycidyl ether are dissolved in 15.28 ml water in a round bottom flask, and the reaction mixture is heated to 80° C. for one hour. 21.22 g of a liquid are obtained, which is subsequently used for application-technological tests.

Preparation Example 5

4.97 g (0.0472 mol) thiomorpholine and 9.64 g (0.0472 mol) glycerol diglycidyl ether are emulsified in 21.92 g water in a round bottom flask, and the reaction mixture is heated to 80° C. for two hours. After the end of the reaction, a yellow oil deposites. 23.60 ml 2-molar hydrochloric acid are added to the reaction mixture and stirred for 30 minutes. 58.15 g of a yellow colourless liquid are obtained, which is subsequently used for application-technological tests.

Preparation Example 6

4.90 ml (0.0490 mol) piperidine and 10 g (0.0490 mol) glycerol diglycidyl ether are dissolved in 15 g water in a round bottom flask, and the reaction mixture is heated to 80° C. for two hours. 35.43 g of a colourless liquid are obtained, which is subsequently used for application-technological tests.

Preparation Example 7

6.20 ml (0.0490 mol) dimethylamine and 10 g (0.0490 mol) glycerol diglycidyl ether are dissolved in 15 g water in a round bottom flask, and the reaction mixture is heated to 80° C. for two hours. 30.52 g of a colourless liquid are obtained, which is subsequently used for application-technological tests.

Preparation Example 8

5 g (0.0574 mol) morpholine and 10 g (0.0490 mol) glycerol diglycidyl ether are dissolved in 22.50 g water in a round bottom flask, and the reaction mixture is heated to 80° C. for one hour. 37.50 g of a colourless liquid are obtained, which is subsequently used for application-technological tests.

Preparation Example 9

5.69 g (0.0653 mol) morpholine and 10 g (0.0490) glycerol diglycidyl ether are dissolved in 23.54 g water in a round bottom flask, and the reaction mixture is heated to 80° C. for one hour. 39.23 g of a colourless liquid are obtained, which is subsequently used for application-technological tests.

Preparation Example 10

4 g (0.0455 mol) morpholine and 9.29 g (0.0455 mol) glycerol diglycidyl ether are dissolved in 19.84 water in a round bottom flask, and the reaction mixture is heated to 60° C. for one hour. 33.13 g of a colourless liquid are obtained, which is subsequently used for application-technological tests.

Comparative Preparation Example 11 According to WO 2004/005528

131.65 ml (0.250 mol) poly(ethylene) diglycidyl ether are charged in a round bottom flask, and 19.75 ml (0.250 mol) epichlorhydrine are added dropwise while stirring within 15 minutes and are stirred for further 15 minutes. This solution is slowly added dropwise to a solution of 21.535 g piperazine in 75 ml water within one hour, without cooling, while stirring strongly. Due to the addition a temperature of 80° C. is obtained, which is not to be exceeded. After the end of the addition, the reaction mixture is stirred for another hour at 80° C., whereby a very viscous solution was obtained. The reaction batch is cooled to room temperature and diluted with 229.81 g water. 500 g solution (40% by weight) were obtained, which reacted after a quarter of an hour. This solid mass was disintegrated by means of the Ultra-Turrax stirrer and adjusted to a 10% by weight polymer emulsion by adding more water. The additive was tested analogously to the General Example of Application.

Comparative Preparation Example 12 According to WO 2004/005528

3.3 ml (0.00625 mol) poly(ethylene glycol) diglycidyl ether are charged in a round bottom flask, and 0.5 ml (0.00625 mol) epichlorhydrine are added dropwise while stirring within 15 minutes and stirred for further 15 minutes. This solution is slowly added dropwise to a solution of piperazine (0.55 g (0.00625 mol)) in 75 ml water at 80° C. within one hour, without cooling, while stirring strongly. After the end of the addition, the reaction mixture is stirred for another hour at 80° C., whereby a very viscous solution was obtained. The reaction batch is cooled to room temperature and diluted with 420 g water. 500 g solution (<1% by weight) were obtained. The additive was tested analogously to the General Example of Application.

General Example of Application

An electrolyte with the following composition is used:

| | | |
|---|---|---|
| 300 | g/l | tetrapotassium pyrophosphate |
| 3 | g/l | copper pyrophosphate monohydrate |
| 30 | g/l | tin pyrophosphate |
| 40 | ml/l | methane sulfonic acid 70% |
| 12.5 | ml/l | phosphoric acid 85% |
| 4 | ml/l | N-methyl pyrrolidone |
| 0.2 | ml/l | of a 40% solution of one of the additives according to the invention in accordance with one of the additives of Preparation Examples 1 to 10. |

250 ml of the electrolyte with a pH value of 7 are filled into a Hull cell. A titanium mixed oxide electrode is used as anode. The cathode plate is coated at 1 A for 10 min. After the end of the coating, the plate is rinsed and dried under compressed air. A glossy deposition was obtained.

TABLE 2

| | | molar ratio | | | |
|---|---|---|---|---|---|
| charge | Preparation Example | amine | diglycidyl ether 1 | diglycidyl ether 2 | appearance |
| 1 | 1 | 1 | 1 | | very glossy white deposition |
| 2 | 2 | 1 | | 1[1] | glossy white deposition |
| 3 | 3 | 1 | 0.5 | 0.5 | glossy white deposition |
| 4 | 4 | 1 | | 1[2] | glossy white deposition |
| 5 | 5 | 1[3] | 1 | | glossy white deposition |
| 6 | 6 | 1[4] | 1 | | glossy white deposition |
| 7 | 7 | 1[5] | 1 | | glossy white deposition |
| 8 | 8 | 1.17 | 1 | | very glossy white deposition |
| 9 | 9 | 1.33 | 1 | | very glossy white deposition |
| 10 | 10[6] | 1 | 1 | | very glossy white deposition |

TABLE 2-continued

| | | molar ratio | | | |
|---|---|---|---|---|---|
| charge | Preparation Example | amine | diglycidyl ether 1 | diglycidyl ether 2 | appearance |
| 11 | Comparative Example 11 | 1[7] | 1[8] | | grey dull deposition with low adhesion |
| 12 | Comparative Example 12 | 1[7] | 1[8] | | glossy white deposition with isolated pores and fogs |

[1]poly(ethylene glycol) diglycidyl ether;
[2]poly(propylene glycol) diglycidyl ether;
[3]thiomorpholine;
[4]piperidine;
[5]dimethylamine;
[6]production at 60° C.;
[7]piperazine; [8]poly(ethylene glycol) diglycidyl ether-epichlorhydrine adduct

The invention claimed is:

1. A method for the galvanic deposition of glossy and even copper-tin alloy coatings, comprising (i) introducing a substrate to be coated into an aqueous cyanide-free pyrophosphate-based electrolyte bath and (ii) galvanically depositing a copper-tin alloy coating on the substrate, wherein the bath has a pH of 3 to 9 and comprises water-soluble copper salts, water-soluble tin salts, a reaction product of a secondary monoamine with a diglycidyl ether and 0.1 to 50 g/l of N-methylpyrrolidone, wherein the secondary monoamine is morpholine and the diglycidyl ether is selected from the group consisting of glycerol diglycidyl ether, poly(propylene glycol) diglycidyl ether, poly(ethylene glycol) diglycidyl ether and mixtures thereof.

2. The method according to claim 1, wherein the diglycidyl ether is glycerol diglycidyl ether.

3. The method according to claim 1, wherein the molar ratio of diglycidyl ether to secondary monoamine is 0.8 to 2.

4. The method according to claim 3, wherein the molar ratio of diglycidyl ether to secondary monoamine is 0.9 to 1.5.

5. The method according to claim 1, wherein the reaction product is contained in the bath in a concentration of 0.0001 to 20 g/l.

6. The method according to claim 5, wherein the reaction product is contained in the bath in a concentration of 0.001 to 1 g/l.

7. The method according to claim 1, wherein the bath further comprises an additive selected from the group consisting of orthophosphoric acid, an organic sulfonic acid, boric acid, an antioxidant agent and an organic brightener.

8. The method according to claim 1, wherein the N-methylpyrrolidone is contained in the bath in a concentration of 0.5 to 15 g/l.

9. The method according the claim 1, wherein the bath has a pH value of 6 to 8.

10. The method according to claim 1, wherein the bath is operated at a set current density of 0.01 to 2 A/dm$^2$.

11. The method according to claim 10, wherein the bath is operated at a set current density of 0.25 to 0.75 A/dm$^2$.

12. The method according to claim 1, wherein the bath is operated at a temperature of 15 to 50° C.

13. The method according to claim 12, wherein the bath is operated at a temperature of 20 to 30° C.

14. The method according to claim 1, wherein membrane anodes are used as anodes in the step of galvanically depositing the copper-tin alloy coating on the substrate.

* * * * *